US009639906B2

(12) United States Patent
O'Gwynn

(10) Patent No.: US 9,639,906 B2
(45) Date of Patent: May 2, 2017

(54) SYSTEM AND METHOD FOR WIDEBAND AUDIO COMMUNICATION WITH A QUICK SERVICE RESTAURANT DRIVE-THROUGH INTERCOM

(71) Applicant: HM Electronics, Inc., Poway, CA (US)

(72) Inventor: David O'Gwynn, Ramona, CA (US)

(73) Assignee: HM Electronics, Inc., Poway, CA (US)

( * ) Notice: Subject to any disclaimer, the term of this patent is extended or adjusted under 35 U.S.C. 154(b) by 361 days.

(21) Appl. No.: 13/797,339

(22) Filed: Mar. 12, 2013

(65) Prior Publication Data

US 2014/0279080 A1 Sep. 18, 2014

(51) Int. Cl.
*G06Q 50/12* (2012.01)

(52) U.S. Cl.
CPC ..... *G06Q 50/12* (2013.01)

(58) Field of Classification Search
CPC .. G06Q 10/087; G06Q 30/06; G06Q 30/0613; G06Q 50/12; G06Q 30/00
USPC ..... 705/15, 26.1; 235/383; 340/286.09, 340/286.06; 455/517, 3.05
See application file for complete search history.

(56) References Cited

U.S. PATENT DOCUMENTS 3,573,379 A 4/1971 Schmitz
3,924,077 A 12/1975 Blakeslee
3,935,396 A 1/1976 Barsellotti
3,941,936 A 3/1976 Graham
4,059,735 A 11/1977 Betts
4,188,511 A 2/1980 Edwards
4,292,475 A 9/1981 Hill
(Continued)

FOREIGN PATENT DOCUMENTS

WO 0072560 A1 11/2000
WO 2004049683 A2 6/2004
(Continued)

OTHER PUBLICATIONS

"Quail Digital Upgrades Drive-Thru Headset System", QSR, Industry News, Mar. 10, 2013, 2 pages.
(Continued)

*Primary Examiner* — Vanel Frenel
(74) *Attorney, Agent, or Firm* — Sheppard Mullin Richter & Hampton LLP

(57) ABSTRACT

This disclosure relates to a quick service restaurant intercom communication system. The system is configured such that communication between a customer and a staff member is accomplished in wideband audio. Intercom communication systems that utilize narrow band audio for communication between drive-through customers and staff members may be considered "good enough". However, the low fidelity sound produced by narrow band audio systems often results in misunderstandings between customers and staff members, a high amount of background noise during communication, and/or other negative effects. Wideband audio may facilitate clearer communication between customers and staff members. Wideband audio communication may be costlier and/or more complicated to implement, but may result in increased staff efficiency and/or increased customer satisfaction. In some implementations, the system may include an audio order placement sub-system, a base station, an order entry device, a mounting mechanism, and/or other components.

36 Claims, 3 Drawing Sheets

(56) References Cited

U.S. PATENT DOCUMENTS 4,313,033 A 1/1982 Walker
4,359,603 A 11/1982 Heaton
4,381,427 A 4/1983 Cheal
4,382,295 A 5/1983 Moffitt
4,389,720 A 6/1983 Baxter
4,416,007 A 11/1983 Huizinga
4,499,578 A 2/1985 Marouf
4,518,821 A 5/1985 Yuter
4,558,180 A 12/1985 Scordo
4,606,021 A 8/1986 Wurst
4,646,288 A 2/1987 Shumway
4,648,108 A 3/1987 Ellis
4,658,398 A 4/1987 Hsing
4,685,134 A 8/1987 Wine
4,716,585 A 12/1987 Tompkins
4,726,016 A 2/1988 Uchida
4,730,306 A 3/1988 Uchida
4,739,205 A 4/1988 Fuhrman
4,740,955 A 4/1988 Litterer
4,797,877 A 1/1989 Pope
4,809,262 A 2/1989 Klose
4,809,270 A 2/1989 Baxter
4,839,888 A 6/1989 Baltz
4,849,750 A 7/1989 Andros
4,901,308 A 2/1990 Deschaine
4,924,464 A 5/1990 Baylock
4,947,440 A 8/1990 Bateman
4,993,073 A 2/1991 Sparkes
5,027,347 A 6/1991 Malkki
5,072,442 A 12/1991 Todd
5,128,928 A 7/1992 Wilder
5,136,585 A 8/1992 Nizamuddin
5,168,354 A * 12/1992 Martinez ..... H04N 7/144 348/150
5,175,727 A 12/1992 Maher
5,191,593 A 3/1993 McDonald
5,195,086 A 3/1993 Baumgartner
5,224,094 A 6/1993 Maher
5,228,026 A 7/1993 Albrow
5,228,076 A 7/1993 Hopner
5,229,989 A 7/1993 Maher
5,241,701 A 8/1993 Andoh
5,260,938 A 11/1993 Hofmann
5,260,941 A 11/1993 Wilder
5,276,678 A 1/1994 Hendrickson
5,309,517 A 5/1994 Barclay
5,321,848 A 6/1994 Miyahira et al. ..... 455/66
5,329,579 A 7/1994 Brunson
5,357,511 A 10/1994 DiNapoli
5,392,278 A 2/1995 Teel
5,416,779 A 5/1995 Barnes
5,416,827 A 5/1995 Gaskill
5,420,860 A 5/1995 Stevens
5,430,725 A 7/1995 Field
5,436,896 A 7/1995 Anderson
5,440,545 A 8/1995 Buchholz
5,483,528 A 1/1996 Christensen
5,515,228 A 5/1996 Nakayama
5,533,112 A 7/1996 Danneels
5,546,077 A 8/1996 Lipp
5,594,727 A 1/1997 Kolbenson
5,715,245 A 2/1998 Suonvieri
5,719,858 A 2/1998 Moore
5,832,389 A * 11/1998 Dent ..... H01Q 1/246 343/700 MS
5,991,634 A 11/1999 Hui
6,044,268 A 3/2000 Haartsen
6,061,348 A 5/2000 Castrigno
6,069,878 A 5/2000 Christensen
6,072,994 A 6/2000 Phillips
6,087,927 A 7/2000 Battistini et al. ..... 340/286.09
6,173,157 B1 1/2001 Godoroja
6,249,527 B1 6/2001 Verthein
6,346,890 B1 2/2002 Bellin
6,393,298 B1 5/2002 Fulton
6,437,743 B1 8/2002 Mintz
6,438,111 B1 8/2002 Catanzaro
6,466,550 B1 10/2002 Foster
6,661,997 B2 12/2003 Ogo ..... 455/41.1
6,671,262 B1 12/2003 Kung
6,687,358 B1 2/2004 Mark
6,696,922 B1 2/2004 Wong
6,717,921 B1 4/2004 Aggarwal
6,728,221 B1 4/2004 Shaffer
6,760,419 B1 * 7/2004 Brown ..... H04L 12/66 370/276
6,782,413 B1 8/2004 Loveland
6,888,935 B1 5/2005 Day
6,920,318 B2 7/2005 Brooking
6,940,826 B1 9/2005 Simard
6,956,828 B2 10/2005 Simard
6,965,868 B1 11/2005 Bednarek
6,973,437 B1 12/2005 Olewicz
7,151,943 B2 12/2006 Comer
7,199,706 B2 4/2007 Dawson
7,233,580 B2 6/2007 Moss
7,236,087 B2 6/2007 Vasquez
7,242,951 B2 7/2007 Helferich
7,313,593 B1 12/2007 Pulito
7,333,821 B2 2/2008 Willey
7,343,174 B2 * 3/2008 Suryanarayana et al. . 455/553.1
7,366,512 B1 4/2008 Kefalas
7,385,479 B1 6/2008 Green
7,711,359 B2 5/2010 Netanel
7,774,231 B2 * 8/2010 Pond et al. ..... 705/15
7,778,594 B2 8/2010 Childers
7,869,424 B2 1/2011 Delveaux
8,015,309 B2 9/2011 Gentle
8,122,131 B2 2/2012 Baum
8,155,283 B2 * 4/2012 Ray ..... H04M 1/738 370/493
8,271,340 B2 * 9/2012 Awiszus ..... 705/26.1
8,334,891 B2 12/2012 Graham
9,058,801 B2 * 6/2015 Po ..... G10K 11/1788
2002/0015398 A1 2/2002 Kikinis
2002/0037054 A1 3/2002 Schurig
2002/0049535 A1 * 4/2002 Rigo et al. ..... 701/211
2002/0105412 A1 8/2002 Carissimo
2002/0137500 A1 9/2002 Brooking
2003/0125954 A1 7/2003 Bradley
2003/0126016 A1 * 7/2003 Asano ..... 705/15
2003/0224815 A1 * 12/2003 Rodman et al. ..... 455/517
2003/0225622 A1 * 12/2003 Doan ..... 705/15
2004/0116071 A1 6/2004 Hall
2004/0213402 A1 10/2004 Ruetschi
2004/0249983 A1 12/2004 Bedner
2005/0008024 A1 1/2005 Newpol
2005/0041603 A1 2/2005 Tighe
2005/0068904 A1 3/2005 Wildfeuer
2005/0076081 A1 4/2005 Rui
2005/0099291 A1 5/2005 Landau
2005/0122389 A1 6/2005 Miao
2005/0135280 A1 6/2005 Lam
2005/0212685 A1 9/2005 Gordon
2005/0260978 A1 * 11/2005 Rader et al. ..... 455/418
2006/0017542 A1 1/2006 Holloway
2006/0041482 A1 2/2006 Awiszus
2006/0050658 A1 3/2006 Shaffer
2006/0056386 A1 3/2006 Stogel
2006/0146737 A1 7/2006 Ohrstrom
2006/0222153 A1 10/2006 Tarkoff
2006/0248221 A1 11/2006 Hottel
2006/0258334 A1 11/2006 Tarallo
2007/0007331 A1 * 1/2007 Jasper et al. ..... 235/379
2007/0019571 A1 1/2007 Stogel
2007/0022018 A1 * 1/2007 Suryanarayana et al. ..... 705/26
2007/0040026 A1 * 2/2007 Vleet ..... G06Q 20/20 235/383
2007/0040652 A1 2/2007 Quatro
2007/0047712 A1 3/2007 Gross
2007/0160081 A1 7/2007 Logvinov
2007/0168468 A1 7/2007 Stogel
2007/0191000 A1 8/2007 Veni
2007/0192196 A1 * 8/2007 Awiszus ..... 705/15

(56) References Cited

U.S. PATENT DOCUMENTS

| | | | | |
|---|---|---|---|---|
| 2007/0208626 | A1* | 9/2007 | Awiszus | 705/26 |
| 2008/0084831 | A1 | 4/2008 | Sylvain | |
| 2008/0211663 | A1 | 9/2008 | Mansfield | |
| 2008/0284627 | A1* | 11/2008 | Feng | H03M 1/1235 341/138 |
| 2008/0300025 | A1* | 12/2008 | Song et al. | 455/569.1 |
| 2009/0013025 | A1 | 1/2009 | Soejima | |
| 2009/0031258 | A1* | 1/2009 | Arrasvuori et al. | 715/863 |
| 2009/0089183 | A1* | 4/2009 | Afram | G06Q 30/0601 705/26.1 |
| 2010/0178869 | A1* | 7/2010 | Mauney et al. | 455/41.2 |
| 2010/0246788 | A1 | 9/2010 | Menard | |
| 2010/0250374 | A1* | 9/2010 | Downes | G06Q 10/103 705/15 |
| 2010/0262689 | A1 | 10/2010 | Ungermann | |
| 2011/0051782 | A1* | 3/2011 | Gupta | H03H 11/12 375/140 |
| 2011/0110467 | A1* | 5/2011 | Maltsev | H04B 1/005 375/340 |
| 2011/0286605 | A1 | 11/2011 | Furuta et al. | 381/71.1 |
| 2012/0140747 | A1* | 6/2012 | Taniguchi | H04W 72/1247 370/337 |
| 2013/0144730 | A1* | 6/2013 | Harman | G06Q 30/06 705/15 |
| 2014/0072134 | A1* | 3/2014 | Po | G10K 11/1788 381/71.11 |

FOREIGN PATENT DOCUMENTS

| | | | |
|---|---|---|---|
| WO | 2004081805 | A1 | 9/2004 |
| WO | 2006116750 | A2 | 11/2006 |
| WO | 2009015460 | A1 | 2/2009 |

OTHER PUBLICATIONS

AES3, Digital Audio Interface Format, file:///Z:/vtec/1003US0/references/AES.shtml, printed Mar. 19, 2009.

Application Note—Power Over Ethernet (PoE), www.cuesystem.com, Czech Republic, Sep. 12, 2007.

Clear-Com to Debut Hybrid TDM/IP Intercom Network at NAB 2009, press release, Clear-Com.RTM. Communication Systems, Feb. 11, 2009.

Handbook of Intercom Systems Engineering, 1st ed., Telex Communications Inc., 2007.

HomePlug AV Technology Overview, Intellon Corp., Orlando, Florida 2008.

Intellon INT6300 Product Brief, Intellon Corp., Orlando, Florida 2008.

International Bureau of WIPO, PCT/IB/373, International Preliminary Report on Patentability for PCT/US10/31078, Oct. 18, 2011, pp. 1-6.

IP Ethernet Intercoms and Paging, Digital Acoustic Corp., printed on Mar. 18, 2009.

New Power Over Ethernet TCP/IP Intercom, Digital Acoustics Corp., http://www.poweroverethernet.com/products.php?article.sub.--id=61, Sep. 29, 2004.

Performer: The Digital Partyline Experience, Riedel Communications, product brochure, Sep. 2008.

PoE—Power Over Ethernet, printed on Mar. 30, 2009 from http://www.altair.org/labnotes.sub.--POE.html.

Telex, 'Handbook of intercom system engineering', Chapter 2 pp. 1-20 Mar. 2002. (online at ftp://ftp.axon.tv/Brochures/Telex/Handbook%20of%20Intercome%20Systems%20E-ngineering.pdf).

Understanding Microphone Cables, printed from http://www.procosound.com/?page=downloads on Mar. 24, 2009.

XLR Connector, Wikipedia, http://en.wikipedia.org, Mar. 21, 2009.

PCT International Search Report for PCT/US14/24535 dated Jul. 29, 2014.

* cited by examiner

SYSTEM AND METHOD FOR WIDEBAND AUDIO COMMUNICATION WITH A QUICK SERVICE RESTAURANT DRIVE-THROUGH INTERCOM

FIELD OF THE DISCLOSURE

This disclosure relates to a quick service restaurant intercom communication system and method. The system is configured such that communication between a customer and a staff member is accomplished in wideband audio.

BACKGROUND

Quick service restaurants are known. Quick service restaurant intercom communication systems are known. Quick service restaurant intercom communication systems typically facilitate communication between a customer outside the quick service restaurant and a staff member inside the quick service restaurant. Conventionally, quick service restaurant intercom communication systems utilize narrowband audio.

SUMMARY

One aspect of the disclosure relates to a quick service restaurant intercom communication system. The quick service restaurant intercom communication system is configured such that communication between drive-through customers and staff members is accomplished in wideband audio. In some implementations, the system may include an audio order placement sub-system that may be positionally associated with a menu board and/or a speaker post, a base station, an audio order receiving sub-system, and/or other components. In some implementations, the audio order placement sub-system may be the menu board and/or the speaker post.

A quick service restaurant may include a kitchen, a drive-through, and/or other components. The quick service restaurant may be configured to serve drive-through and/or walk in customers. The kitchen may include a kitchen display system, and/or other components. A menu board, a speaker post, the audio order placement sub-system, the base station, the audio order receiving sub-system, a drive through lane, and/or other devices may be associated with the drive-through. The audio order receiving sub-system may be configured to be worn by a staff member associated with the drive-through lane. The staff member may enter orders from drive-through customers into an order entry device and/or other devices. Customers may place orders at ordering stations operated by staff members within the restaurant and/or in the drive-through lane at the audio order placement sub-system. Orders may be displayed to staff members preparing the orders via the kitchen display system, for example. Staff members of the quick service restaurant may prepare the orders while the customers wait at the ordering stations, in the drive-through lane, and/or at other locations. Preparing the orders may include cooking and/or otherwise assembling the orders in the kitchen and/or other areas of the quick service restaurant.

The audio order placement sub-system may be configured to receive voice sound indicating orders from customers and facilitate communication between the customers and staff members. The audio order placement sub-system may be positionally associated with the menu board and/or the speaker post. In some implementations, the audio order placement sub-system may include one or more of a first microphone, a first speaker, and/or other components. In some implementations, the first microphone may include an array of microphones (e.g., an array microphone). The first speaker may include an array of speakers. The first microphone, the first speaker and/or other components of the audio order placement sub-system may be mounted within and/or near the menu board and/or the speaker post. In some implementations, the components of the audio order placement sub-system (e.g., first microphone, first speaker) may be mounted separately. For example, the first microphone and the first speaker may be mounted in separate enclosures within the menu board and/or the speaker post. The first microphone may be configured to receive sound from a customer placing an order at or near the menu board and to generate wideband order information signals that represent the received sound. The first speaker may be configured to receive wideband order information signals and to generate sound represented in the received wideband order information signals. The first speaker may be configured to generate the sound such that the sound is audible to a customer at or near the menu board and/or the speaker post.

The base station may be configured to communicate with the audio order placement sub-system and one or more audio order receiving sub-systems wirelessly and/or via wires. In some implementations, the base station may include one or more of a first transceiver, a first signal processor, and/or other components. The first transceiver may be configured to transmit and receive encoded audio communication signals. The encoded audio communication signals may be transmitted to the audio order receiving sub-system and received from the audio order receiving sub-system, for example. In some implementations, the first transceiver may be configured to transmit and receive encoded audio communication signals substantially simultaneously. The first signal processor may be configured to encode wideband order information signals received from the first microphone into encoded audio communication signals for transmission by the first transceiver. The first signal processor may be configured to decode encoded audio communication signals received by the first transceiver into wideband order information signals for the first speaker.

The audio order receiving sub-system may be configured to receive voice communication from the staff members and facilitate communication between customers and staff members. In some implementations, the audio order receiving sub-system may be configured to be worn by a staff member. The audio order receiving sub-system may be located remotely from the audio order placement sub-system. The audio order receiving sub-system may be associated with the order entry device such that staff members may enter an order placed by a customer into the order entry device. In some implementations, the audio order receiving sub-system may include one or more of a second transceiver, a second microphone, a second speaker, a second signal processor, and/or other components. The second transceiver may be configured to transmit encoded audio communication signals to the first transceiver of the base station and receive encoded audio communication signals from the first transceiver of the base station. In some implementations, the second transceiver may be configured to transmit and receive encoded audio communication signals substantially simultaneously. Transmitting and/or receiving encoded audio communication signals to and/or from the first transceiver of the base station may facilitate communication between customers and staff members. The second microphone may be configured to receive sound generated by staff members and to generate wideband order information signals that represent the received sound. In some implementations, the second microphone may be held by the audio order receiving sub-system. The second speaker may be configured to receive wideband order information signals and to generate sound represented in the received wideband order information signals. In some implementations, the second speaker may be held by the audio order receiving sub-system. The sound may be generated such that the sound is audible to staff members. The second signal processor may be configured to encode wideband order information signals received from the second microphone into encoded audio communication signals for transmission by the second transceiver. The second signal processor may be configured to decode encoded audio communication signals received by the second transceiver into wideband order information signals for the second speaker.

The wideband order information signals and/or the encoded audio communication signals may represent sound having a frequency range in a wideband audio frequency range. The wideband order information signals and/or the encoded audio communication signals may represent sound having a wideband audio frequency range such that communication between customers and staff members may be accomplished in wideband audio.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
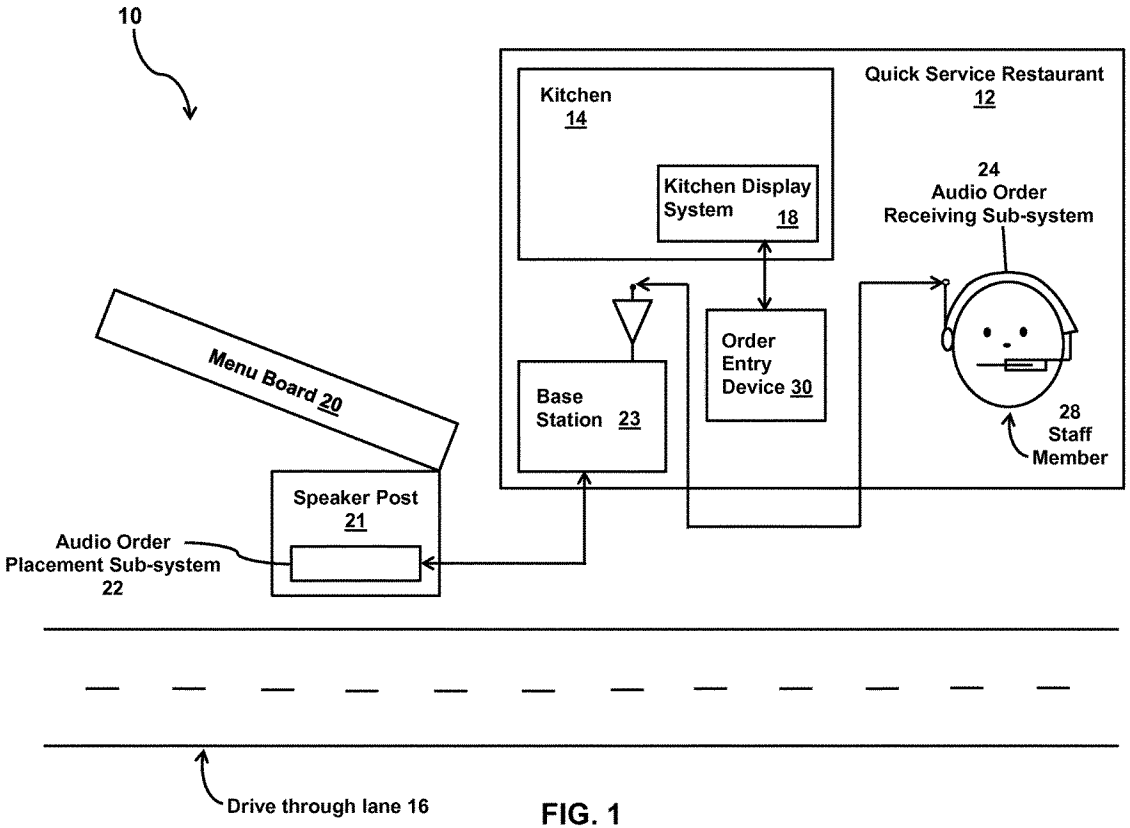
FIG. 1 illustrates a quick service restaurant intercom communication system.

FIG. 1 illustrates a quick service restaurant intercom communication system 10. Quick service restaurant intercom communication system 10 may be configured such that communication between drive-through customers and staff members is accomplished in wideband audio. Intercom communication systems that utilize narrowband audio for communication between drive-through customers and staff members may be considered "good enough". However, the low fidelity sound produced by narrowband audio systems often results in misunderstandings between customers and staff members, and/or other negative effects. These negative effects may decrease customer satisfaction with a quick service restaurant as a whole.

In system 10, wideband audio may facilitate clearer communication between customers and staff members. The clearer communication facilitated by wideband audio may be particularly advantageous in quick service restaurant settings because quick service restaurants are typically located on busy streets and/or highways. Background noise from the surrounding area and/or engine noise from vehicles in the drive-through may be substantial. Quick service restaurant staff members who serve drive-through customers for an extended period of time may benefit from clearer communication, reduced listening effort, and reduced fatigue facilitated by wideband audio. Wideband audio communication may be costlier and/or more complicated to implement, but may result in increased staff efficiency and/or increased customer satisfaction. The increased staff efficiency and/or increased customer satisfaction may result from higher quality speech heard by both customers and staff members. For customers and/or staff members, wideband audio may improve intelligibility in the presence of the background noise described above. Wideband audio may facilitate a clearer understanding of accented speakers, make it easier to understand two people speaking at the same time, make it easier to hear people with soft voices, reduce listening effort, facilitate distinguishing different but similar sounds, and/or result in other advantages. For example, quick service restaurant staff members stationed at the drive-through may feel less fatigued after multiple intercom communications with multiple customers because of the reduced listening effort facilitated by wideband audio. As another example, order accuracy may go up because customers and staff members may communicate more clearly in the presence of background noise. The customer experience may be improved because the communication between customers and staff members may be more natural. Customer loyalty may increase as a result of the advantages of wideband audio. In some implementations, system 10 may include one or more of an audio order placement sub-system 22, a base station 23, an audio order receiving sub-system 24, and/or other components.

The description herein of system 10 in connection with a quick service restaurant is not intended to be limiting. Wideband audio intercom communication systems like system 10 may be beneficial in other applications such as drive-through pharmacies, drive-through banking, customer service booths (e.g., at movie theaters, theme parks, concert halls, zoos), and/or other applications.

As shown in FIG. 1, a quick service restaurant 12 may include a kitchen 14, a drive-through lane 16, and/or other components. Quick service restaurant 12 may be configured to serve drive-through and/or walk in customers. Kitchen 14 may include a kitchen display system 18, and/or other components. A menu board 20, a speaker post 21, audio order placement sub-system 22, base station 23, audio order receiving sub-system 24, and/or other devices may be associated with drive-through lane 16. Audio order receiving sub-system 24 may be configured to be worn by a staff member 28 associated with drive-through lane 16. Staff member 28 may enter orders from drive-through customers into an order entry device 30 (e.g., a point of sale (POS) terminal) and/or other devices. The orders may be received by a central POS system via the POS terminal which then sends the necessary information to kitchen display system 18. Customers may place orders at ordering stations operated by staff members within the restaurant and/or in drive-through lane 16 at menu board 20 and/or speaker post 21 via audio order placement sub-system 22. Orders may be displayed to staff members preparing the orders via kitchen display system 18, for example. Staff members of the quick service restaurant may prepare the orders while the customers wait at the ordering stations, in drive-through lane 16, and/or at other locations. Preparing the orders may include cooking and/or otherwise assembling the orders in kitchen 14 and/or other areas of quick service restaurant 12.

Kitchen display system 18 may be configured to receive order information from order entry device 30 and display order state information related to the food orders in kitchen 14. Order information may include for example, food and/or beverage items from the menu board, quantities associated with the food and/or beverage items, pricing information such as coupon discounts, and/or other information. The order state information may comprise information related to the current preparation of the food order. For example, order state information may include information indicating that an order is in the process of being assembled and/or information indicating that an order has been completed and/or delivered to a customer. The order state information may be displayed by kitchen display system 18 such that kitchen staff may prepare the customer orders and track the progress (e.g., state to state) through kitchen 14. Kitchen display system 18 may include multiple displays wherein individual ones of the displays show slightly different information compared to the other displays. For example, a display may be tailored for a particular state of food preparation. In some implementations, kitchen display system 18 may include a kitchen video system (KVS).

Drive-through lane 16 may be located adjacent to and/or near quick service restaurant 12. Drive-through lane 16 may be configured such that customers driving vehicles through drive-through lane 16 may access one or more of menu board 20, speaker post 21, audio order placement sub-system 22, a payment and/or pickup window, and/or other components of quick service restaurant 12. The payment and/or pickup window may be a window in quick service restaurant 12 operated by staff members through which customers in drive-through lane 16 may pay for and/or pick up their orders without leaving their vehicles.

Menu board 20 may be located at and/or near drive-through lane 16 in proximity to quick service restaurant 12. Menu board 20 may be configured to display menu items offered by quick service restaurant 12 to customers in drive-through lane 16. In some implementations, menu board 20 may include static printed materials, digital signage, and/or other signage. Digital signage may allow menu board 20 to be changed by employees of quick service restaurant 12 and/or other people. Menu board 20 may allow customers to view menu items from drive-through lane 16 of quick service restaurant 12. Menu board 20 may be configured to house audio order placement sub-system 22, and/or one or more components of audio order placement sub-system 22. In some implementations, menu board 20 may be audio order placement sub-system 22.

Speaker post 21 may be located at and/or near drive-through lane 16 in proximity to quick service restaurant 12 and menu board 20. Speaker post 21 may comprise a physical object (e.g., a post) configured to contain components (e.g., audio order placement sub-system 22) configured to facilitate communication between customers and staff members of the quick service restaurant. Speaker post 21 may be configured with any form factor such that audio order placement sub-system 22 is accessible to drivers in drive-through lane 16 to facilitate communication between customers placing orders while sitting in their vehicles and staff members. Speaker post 21 may be configured to house audio order placement sub-system 22, and/or one or more components of audio order placement sub-system 22. In some implementations, speaker post 21 may be audio order placement sub-system 22.

Audio order placement sub-system 22 may be configured to receive voice sound indicating orders from customers and facilitate communication between the customers and staff members (e.g., staff member 28) via base station 23, audio order receiving sub-system 24, and/or other components of system 10. Audio order placement sub-system 22 may be positionally associated with menu board 20 and/or speaker post 21. In some implementations, audio order placement sub-system 22 may include one or more of a microphone, a speaker, and/or other components. The microphone, the speaker and/or other components of audio order placement sub-system 22 may be mounted within and/or near menu board 20 and/or speaker post 21. In some implementations, the components of audio order placement sub-system 22 (e.g., microphone, speaker) may be mounted separately. For example, the first microphone and the first speaker may be mounted in separate enclosures within the menu board and/or the speaker post. In some implementations, audio order placement sub-system 22 may be an entity separate from menu board 20. In some implementations audio order placement sub-system 22 may form an order point separate from menu board 20 that does not include a speaker post (e.g., speaker post 21).

Audio order placement sub-system 22 and/or the components (e.g., speaker, microphone) of audio order placement sub-system 22 may be mounted with one or more mechanical devices configured to hold the components of audio order placement sub-system 22, and/or audio order placement sub-system 22 within and/or near menu board 20 and/or speaker post 21. Holding may include supporting the weight of the components of audio order placement sub-system 22, coupling the components of audio order placement sub-system 22 to menu board 20 and/or speaker post 21, and/or other actions. For example, the mechanical devices may include one or more screws, brackets, hooks, cantilevers, suction devices, hinges, pins, sleeves, joints, chassis, slots, foam blocks, and/or other mechanical devices.

Figure 2:
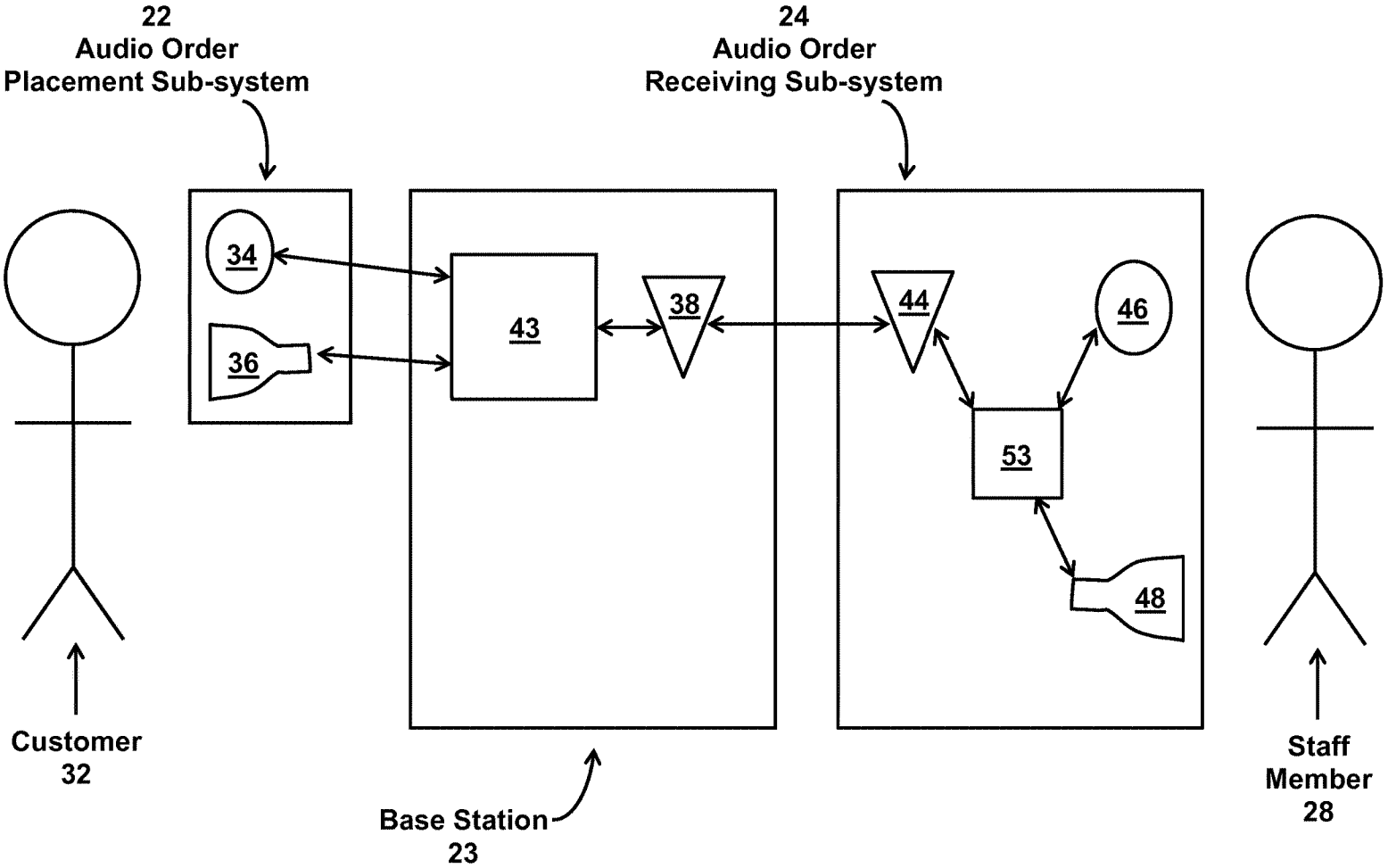
FIG. 2 illustrates components of an audio order placement sub-system, a base station, and an audio order receiving sub-system.

FIG. 2 illustrates components of audio order placement sub-system 22. In some implementations, audio order placement sub-system 22 may include one or more of a microphone 34, a speaker 36, and/or other components. Microphone 34 may be configured to receive sound from a customer 32 placing an order at or near a menu board (e.g., menu board 20 shown in FIG. 1) and to generate wideband order information signals that represent the received sound. The received sound may be in the wideband frequency range. The received sound may include sound communicating food and/or beverage items from the menu board, quantities associated with the food and/or beverage items, special preparation requirements (e.g., no onions), and/or other information. In some implementations, microphone 34 may include an array of microphones (e.g., an array microphone). In some implementations, microphone 34 may be associated with an analog to digital converter configured to digitize the received sound.

Speaker 36 may be configured to receive wideband order information signals and to generate sound represented in the received wideband order information signals. In some implementations, speaker 36 may include an array of speakers. Speaker 36 may be configured to generate the sound such that the sound is audible to a customer 32 at or near the menu board. For example, the sound represented in the received wideband order information signals may be the voice of staff member 28 responding to customer 32. In some implementations, speaker 36 may be associated with a digital to analog converter configured to generate analog audio for speaker 36.

Returning to FIG. 1, base station 23 may be configured to facilitate wideband audio communication between customers and staff members via audio order placement sub-system 22, audio order receiving sub-system 24, and/or other components of system 10. Base station 23 may be configured to communicate with audio order placement sub-system 22 and one or more audio order entry receiving sub-systems 24 wirelessly and/or via wires.

FIG. 2 illustrates components of base station 23. In some implementations, base station 23 may include one or more of a transceiver 38, a signal processor 43, and/or other components. Transceiver 38 may be configured to transmit and receive encoded audio communication signals. The encoded audio communication signals may be transmitted to audio order receiving sub-system 24 and received from audio order receiving sub-system 24, for example. In some implementations, the encoded audio communication signals may be transmitted and/or received wirelessly and/or via wires. In some implementations, transceiver 38 may be configured to transmit and receive the encoded audio communication signals via one or more radio channels of a radio link. In some implementations, transceiver 38 may be configured to transmit and receive encoded audio communication signals substantially simultaneously.

In some implementations, a communication protocol associated with transceiver 38 may be configured for narrow-band audio. The communication protocol may specify a number of bits per frame. For example, the communication protocol may specify 320 bits per frame.

Signal processor 43 may be configured to encode and/or compress wideband order information signals received from microphone 34 into encoded audio communication signals for transmission by transceiver 38. Signal processor 43 may be configured to decode and/or decompress encoded audio communication signals received by transceiver 38 into wideband order information signals for speaker 36. In some implementations, signal processor 43 may include one or more individual processing units. In some implementations, signal processor 43 may be configured to provide wideband noise suppression and/or acoustic echo cancellation (e.g., for the sound received by microphone 34). In some implementations, signal processor 43 may perform digital audio data rate compression and/or decompression. In some implementations, signal processor 43 may perform digital audio data rate compression such that the encoded audio communication signals transmitted by transceiver 38 fit in the same radio data stream occupied by narrowband audio. In some implementations, an encoding and/or compression format may be associated with signal processor 43 such that the wideband order information signals may be compressed into frames having a number of bits per frame that is based on the communication protocol associated with transceiver 38 (e.g., 320 bits per frame).

In some implementations, signal processor 43 may provide up to about 8:1 data compression. In some implementations, signal processor 43 may provide data compression according to an algorithm such as BV32. In some implementations, signal processor 43 may provide less than 8:1 data compression. For example, signal processor 43 may provide less than 8:1 data compression when the transmitted signals occupy more than one time slot (e.g., for digital radios that use time division multiplexing).

Signal processor 43 in base station 23 may include two separate digital signal processors with one digital signal processor performing wideband acoustic echo cancellation and noise suppression, and the second digital signal processor performing the data compression encoding and decoding (e.g., encoding and/or decoding depending on whether communication is from a customer to a staff member or from a staff member to a customer). In some implementations, digital signal processor 43 may be integrated with transceiver 38 as a single component of base station 23.

Audio order receiving sub-system 24 may be configured to receive voice communication (e.g., sound) from staff member 28 and facilitate communication between customer 32 and staff member 28 via base station 23, audio order placement sub-system 22, and/or other components of system 10. In some implementations, audio order receiving sub-system 24 may be configured to be worn by a staff member. In some implementations, audio order receiving sub-system 24 may be configured to be worn as one or more of a headset, a belt, an armband, an earpiece, and/or other devices. Audio order receiving sub-system 24 may be located remotely from audio order placement sub-system 22. Audio order receiving sub-system 24 may be associated with order entry device 30 such that staff member 28 may enter an order placed by a customer into order entry device 30.

In some implementations, audio order receiving sub-system 24 may include one or more of a transceiver 44, a microphone 46, a speaker 48, a signal processor 53, and/or other components. Transceiver 44 may be configured to transmit encoded audio communication signals to transceiver 38 of base station 23 and receive encoded audio communication signals from transceiver 38. In some implementations, transceiver 44 may be configured to transmit and receive the encoded audio communication signals via one or more radio channels of a radio link. In some implementations, transceiver 44 may be configured to transmit and receive encoded audio communication signals substantially simultaneously. Transmitting and/or receiving encoded audio communication signals to and/or from transceiver 38 may facilitate communication between customer 32 (via audio order placement sub-system 22) and staff member 28.

In some implementations, similar to transceiver 38 described above, a communication protocol associated with transceiver 44 may be configured for narrow-band audio. The communication protocol may specify a number of bits per frame. For example, the communication protocol may specify 320 bits per frame.

Microphone 46 may be configured to receive sound generated by staff member 28 and to generate wideband order information signals that represent the received sound. The received sound may be in the wideband frequency range. In some implementations, microphone 46 may be associated with an analog to digital converter configured to digitize the received sound. The received sound may include, for example, sound communicating a confirmation of the food and/or beverage items from the menu board, a cost of the order, instructions to move a vehicle through drive-through lane 16 (shown in FIG. 1), and/or other information. In some implementations, microphone 46 may be held by audio order receiving sub-system 24.

Speaker 48 may be configured to receive wideband order information signals and to generate sound represented in the received wideband order information signals. In some implementations, speaker 48 may be associated with a digital to analog converter configured to generate analog audio for speaker 48. The sound may be generated such that the sound is audible to staff member 28. The sound represented in the received wideband order information signals may be the voice of customer 32 placing an order, for example. In some implementations, speaker 48 may be held by audio order receiving sub-system 24.

Signal processor 53 may be configured to encode and/or compress wideband order information signals received from microphone 46 into encoded audio communication signals for transmission by transceiver 44. Signal processor 53 may be configured to decode and/or decompress encoded audio communication signals received by transceiver 44 into wideband order information signals for speaker 48. For example, whether signal processor 53 is encoding or decoding may depend on whether communication is from a customer to a staff member or from a staff member to a customer. In some implementations, signal processor 53 may include one or more individual processing units. In some implementations, signal processor 53 may be configured to provide wideband noise suppression and/or acoustic echo cancellation (e.g., in the sound received by microphone 46). In some implementations, signal processor 43 of base station 23 may be configured to suppress noise received by microphone 46 of audio order receiving sub-system 24. In some implementations, signal processor 53 may perform digital audio data rate compression and/or decompression. In some implementations, signal processor 53 may perform digital audio data rate compression such that the encoded audio communication signals transmitted by transceiver 44 fit in the same radio data stream occupied by narrow band audio. In some implementations, an encoding and/or compression format may be associated with signal processor 53 such that the wideband order information signals may be compressed into frames having a number of bits per frame that is based on the communication protocol associated with transceiver 44 (e.g., 320 bits per frame).

In some implementations, signal processor 53 may provide up to about 8:1 data compression. In some implementations, signal processor 43 may provide data compression according to an algorithm such as BV32. In some implementations, signal processor 53 may provide less than 8:1 data compression. For example, signal processor 53 may provide less than 8:1 data compression when the transmitted signals occupy more than one time slot (e.g., for digital radios that use time division multiplexing). In some implementations, signal processor 53 may be integrated with transceiver 44 as a single component of audio order receiving sub-system 24.

The wideband order information signals and/or the encoded audio communication signals may represent sound having a frequency range in a wideband audio frequency range. The wideband order information signals and/or the encoded audio communication signals may represent sound having a wideband audio frequency range such that communication between customer 32 and staff member 28 may be accomplished in wideband audio. For example, accomplishing the communication between customer 32 and staff member 28 in wideband audio may facilitate enhancement of the voice clarity of staff member 28 heard by customer 32 and/or additional improvements relative to narrow band audio. In some implementations, the wideband order information signals and the encoded audio communication signals represent sound having a frequency range minimum and a frequency range maximum about 7000 Hz apart. In some implementations, the wideband order information signals and the encoded audio communication signals may represent sound having a frequency bandwidth of about 7000 Hz. In some implementations, the wideband order information signals and the encoded audio communication signals represent sound having a minimum frequency of between about 50 Hz and about 300 Hz, and/or a maximum frequency of up to about 8000 Hz. In some implementations, the wideband order information signals and the encoded audio communication signals may represent sound having a frequency range minimum and a frequency range maximum greater than about 4000 Hz apart. In some implementations, the wideband order information signals and the encoded audio communication signals may represent sound having a frequency bandwidth of greater than about 4000 Hz. As such, the components of system 10 may be specifically tailored for wideband audio communication. For example, the analog to digital and digital to analog converters may operate with 16 kHz sample rates and pass audio frequencies up to 8 kHz.

Returning to FIG. 1, order entry device 30 may be configured to receive entry and/or selection of orders from customers by staff member 28. In some implementations, staff member 28 may manually key the order information (e.g., food and/or beverage items from the menu board, quantities associated with the food and/or beverage items, pricing information), and/or other information into order entry device 30. In some implementations, staff member 28 may speak order information into order entry device 30 and/or input order information into order entry device 30 by other methods. In some implementations, order entry device 30 may manage payment for the orders. Managing payment may include processing credit card payments, receiving cash payments, and/or other management. Order entry device 30 may be configured to electronically send information related to the orders to kitchen display system 18. Examples of order entry device 30 may include cash registers, point of sale (POS) systems, and/or other devices.

Figure 3:
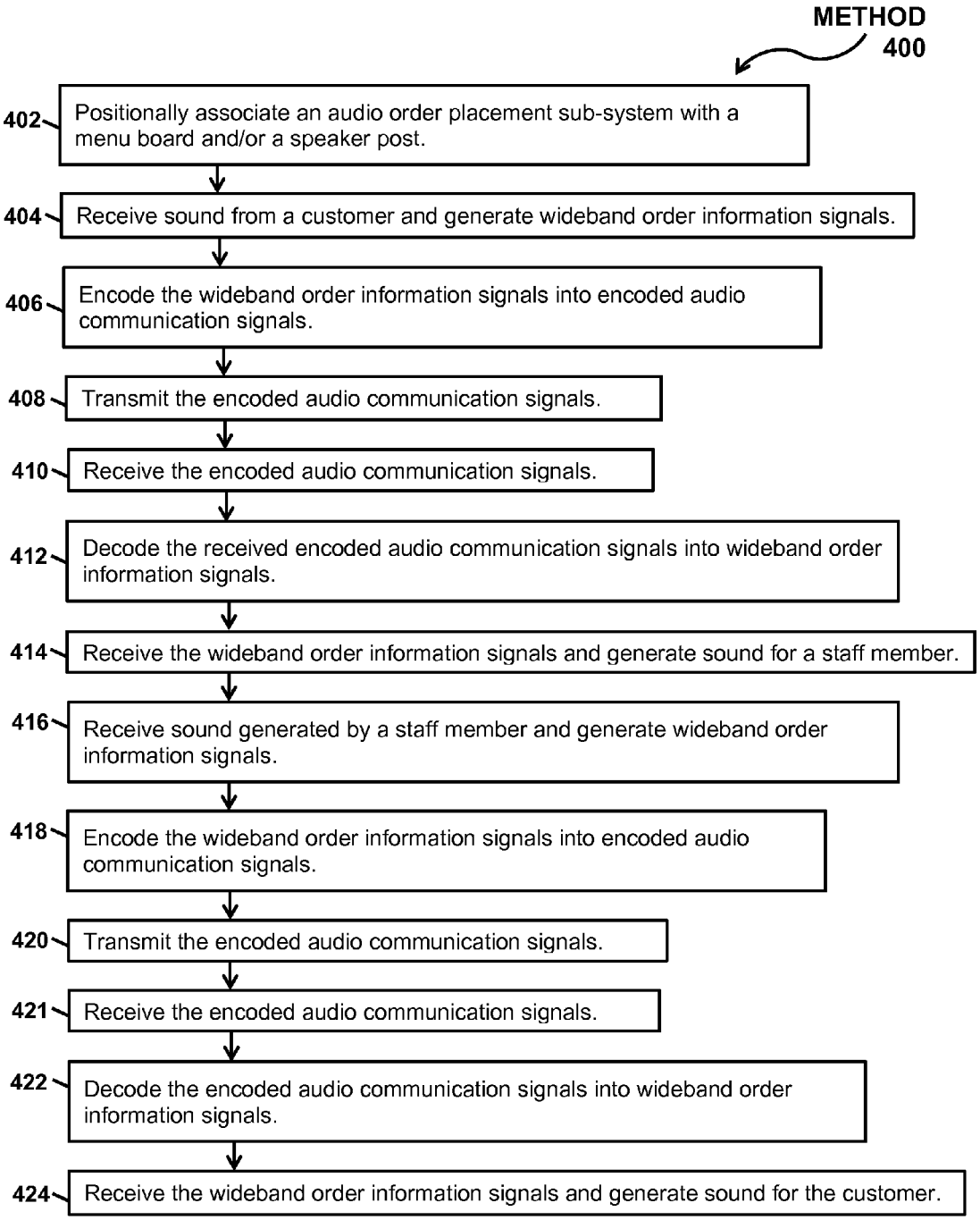
FIG. 3 illustrates a method of communication with a quick service restaurant intercom communication system.

FIG. 3 illustrates a method 400 of communication with a quick service restaurant intercom communication system. The operations of method 400 presented below are intended to be illustrative. In some implementations, method 400 may be accomplished with one or more additional operations not described, and/or without one or more of the operations discussed. Additionally, the order in which the operations of method 400 are illustrated in FIG. 3 and described below is not intended to be limiting. In some implementations, two or more of the operations may occur substantially simultaneously.

In some implementations, method 400 may be implemented in one or more processing devices (e.g., a digital processor, an analog processor, a digital circuit designed to process information, an analog circuit designed to process information, a state machine, and/or other mechanisms for electronically processing information). The one or more processing devices may include one or more devices executing some or all of the operations of method 400 in response to instructions stored electronically on one or more electronic storage mediums. The one or more processing devices may include one or more devices configured through hardware, firmware, and/or software to be specifically designed for execution of one or more of the operations of method 400.

At an operation 402, an audio order placement sub-system may be positionally associated with respect to a menu board and/or a speaker post. The menu board and/or the speaker post may be associated with a quick service restaurant. In some implementations, the audio order placement sub-system may include a speaker and/or a microphone. In some implementations, the speaker and/or the microphone of the audio order placement sub-system may be mounted in the menu board. In some implementations, the speaker and/or the microphone of the audio order placement sub-system may be mounted in the speaker post. In some implementations, operation 402 may be performed by a menu board and/or a speaker post the same as or similar to menu board 20 and/or speaker post 21 (shown in FIG. 1 and described herein).

At an operation 404, sound may be received from a customer placing an order at or near the menu board. Wideband order information signals that represent the received sound may be generated. In some implementations, operation 404 may be performed by a microphone the same as or similar to microphone 34 (shown in FIG. 2 and described herein).

At an operation 406, the wideband order information signals that represent the sound received from the customer may be encoded into encoded audio communication signals for transmission. In some implementations, the wideband order information signals may be compressed before transmission. In some implementations, operation 406 may be performed by a signal processor of a base station the same as or similar to signal processor 43 (shown in FIG. 2 and described herein).

At an operation 408, the encoded audio communication signals encoded by the signal processor of the base station may be transmitted with a transceiver of the base station. In some implementations, operation 408 may be performed by a transceiver the same as or similar to transceiver 38 (shown in FIG. 2 and described herein).

At an operation 410, the encoded audio communication signals transmitted by the transceiver of the base station may be received with a transceiver of an audio order receiving sub-system. The encoded audio communication signals may be received from the transceiver of the base station to facilitate communication between the customer and a staff member. The audio order receiving sub-system may be located remotely from the audio order placement sub-system. The audio order receiving sub-system may be configured to be worn by the staff member of the quick service restaurant. In some implementations, operation 410 may be performed by a transceiver the same as or similar to transceiver 44 (shown in FIG. 2 and described herein).

At an operation 412, the encoded audio communication signals received by the transceiver of the audio order receiving sub-system may be decoded. The received encoded audio communication signals may be decoded with a signal processor of the audio order receiving sub-system into wideband order information signals for a speaker of the audio order receiving sub-system. In some implementations, operation 412 may be performed by a signal processor the same as or similar to signal processor 53 (shown in FIG. 2 and described herein).

At an operation 414, the wideband order information signals decoded by the signal processor of the audio order receiving sub-system may be received and sound represented in the received wideband order information signals may be generated. The sound may be generated such that the sound is audible to the staff member. In some implementations, operation 414 may be performed by a speaker of the audio order receiving sub-system the same as or similar to speaker 48 (shown in FIG. 2 and described herein). In some implementations, the speaker may be held by the audio order receiving sub-system.

At an operation 416, sound generated by the staff member may be received and wideband order information signals that represent the received sound may be generated. In some implementations, operation 416 may be performed by a microphone of the audio order receiving sub-system the same as or similar to microphone 46 (shown in FIG. 2 and described herein). In some implementations, the microphone may be held by the audio order receiving sub-system.

At an operation 418, the wideband order information signals received from the microphone of the audio order receiving sub-system may be encoded into encoded audio communication signals for transmission by the transceiver of the audio order receiving sub-system. In some implementations, the wideband order information signals may be compressed. In some implementations, operation 418 may be performed by the signal processor of the audio order receiving sub-system the same as or similar to signal processor 53 (shown in FIG. 2 and described herein).

At an operation 420, the encoded audio communication signals encoded by the signal processor of the audio order receiving sub-system may be transmitted to the transceiver of the base station. In some implementations, operation 420 may be performed by the transceiver of the audio order receiving sub-system that is the same as or similar to transceiver 44 (shown in FIG. 2 and described herein).

At an operation 421, the encoded audio communication signals transmitted by the transceiver of the audio order receiving sub-system may be received with the transceiver of the base station. In some implementations, operation 421 may be performed by a transceiver the same as or similar to transceiver 38 (shown in FIG. 2 and described herein).

At an operation 422, received encoded audio communication signals may be decoded into wideband order information signals for a speaker of the audio order placement sub-system. The received encoded audio communication signals may be the encoded audio communication signals received with the transceiver of the base station. The received encoded audio communication signals may be decoded with the signal processor of the base station. In some implementations, operation 422 may be performed by the signal processor of the base station the same as or similar to signal processor 43 (shown in FIG. 2 and described herein).

At an operation 424, the wideband order information signals decoded with the signal processor of the base station may be received and sound represented in the received wideband order information signals may be generated. The wideband order information signals may be received and the sound may be generated such that the generated sound is audible to the customer at or near the menu board with the speaker of the audio order placement sub-system. In some implementations, operation 424 may be performed by a speaker the same as or similar to speaker 36 (shown in FIG. 2 and described herein).

The wideband order information signals and the encoded audio communication signals described in the operations above may represent sound having a frequency range in a wideband audio frequency range such that communication between the customer and the staff member is accomplished in wideband audio.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. An intercom communication system for a quick service restaurant drive-through, the drive-through including a menu board and/or a speaker post, the system comprising:

an audio order placement sub-system positionally associated with one or both of the menu board or the speaker post, the audio order placement sub-system comprising:

a first microphone configured to receive sound from a customer placing an order at or near the menu board, and to generate wideband order information signals that represent the received sound;

an analog-to-digital converter configured to receive the generated wideband order information signals from the first microphone and further configured to convert the generated wideband order information signals to digital form; and a first speaker configured to receive wideband order information signals and to generate sound represented in the received wideband order information signals such that the generated sound is audible to the customer at or near the menu board;

a base station, the base station comprising:

a first transceiver configured to transmit and receive encoded audio communication signals;

a first digital signal processor configured to encode wideband order information signals received from the analog-to-digital converter into encoded audio communication signals for transmission by the first transceiver, and decode encoded audio communication signals received by the first transceiver into wideband order information signals for the first speaker; and an audio order receiving sub-system configured to be worn by a staff member, the audio order receiving sub-system located remotely from the audio order placement sub-system, the audio order receiving sub-system comprising:

a second transceiver configured to transmit encoded audio communication signals to the first transceiver and receive encoded audio communication signals from the first transceiver to facilitate communication between the customer and the staff member;

a second microphone configured to receive sound generated by the staff member and to generate wideband order information signals that represent the received sound;

a second speaker configured to receive wideband order information signals and to generate sound represented in the received wideband order information signals such that the generated sound is audible to the staff member; and a second signal processor configured to encode wideband order information signals received from the second microphone into encoded audio communication signals for transmission by the second transceiver, and decode encoded audio communication signals received by the second transceiver into wideband order information signals for the second speaker;

wherein the wideband order information signals and the encoded audio communication signals represent sound having a frequency range in a wideband audio frequency range such that communication between the customer and the staff member is accomplished in wideband audio.

2. The system of claim 1, wherein the wideband order information signals and the encoded audio communication signals represent sound having a frequency range minimum and a frequency range maximum about 7000 Hz apart.

3. The system of claim 1, wherein the wideband order information signals and the encoded audio communication signals represent sound having a frequency range minimum and a frequency range maximum greater than about 4000 Hz apart.

4. The system of claim 1, wherein the wideband order information signals and the encoded audio communication signals represent sound having a minimum frequency between about 50 Hz and about 300 Hz and a maximum frequency of up to about 8000 Hz.

5. The system of claim 1, wherein the first digital signal processor and the second signal processor are configured to compress wideband order information signals before transmission.

6. The system of claim 5, wherein the first digital signal processor and the second signal processor are configured such that a compression ratio of the compression is up to about 8:1.

7. The system of claim 1, wherein the customer is in a drive-through lane of the quick service restaurant.

8. The system of claim 1, wherein the first digital signal processor is configured to provide acoustic echo cancellation.

9. The system of claim 1, wherein the second signal processor is configured to provide acoustic echo cancellation.

10. The system of claim 1, wherein the first digital signal processor is configured to provide noise reduction processing.

11. The system of claim 1, wherein the second signal processor is configured to provide noise reduction processing.

12. The system of claim 1, wherein one or both of the first microphone or the first speaker are mounted in the menu board.

13. The system of claim 1, wherein one or both of the first microphone or the first speaker are mounted in the speaker post.

14. The system of claim 1, wherein the audio order receiving sub-system is associated with an order entry device configured to receive entry and/or selection of an order by the staff member.

15. The system of claim 14, wherein the order entry device is configured to transmit the order to a kitchen display system of the quick service restaurant.

16. The system of claim 14, wherein the order entry device is configured to process a payment.

17. The system of claim 1, wherein the first microphone is an array of microphones.

18. The system of claim 1, wherein the first speaker is an array of speakers.

19. The system of claim 1, wherein the first transceiver and the second transceiver are configured to transmit encoded audio communication signals using multiple time slots.

20. A method of communication with an intercom communication system for a quick service restaurant drive-through, the quick service restaurant drive-through including a menu board and/or a speaker post, the method comprising:

positionally associating an audio order placement sub-system with one or both of the menu board or the speaker post;

receiving sound from a customer placing an order at or near the menu board and generating wideband order information signals that represent the received sound with a first microphone of the audio order placement sub-system;

receiving the generated wideband order information from the first microphone and converting the generated wideband order information signals to digital form;

encoding, with a first digital signal processor of a base station, the wideband order information signals that represent the sound received from the customer in digital form into encoded audio communication signals for transmission;

transmitting the encoded audio communication signals encoded with the first digital signal processor of the base station with a transceiver of the base station;

receiving, with a transceiver of an audio order receiving sub-system, the encoded audio communication signals from the transceiver of the base station to facilitate communication between the customer and a staff member, the audio order receiving sub-system located remotely from the audio order placement sub-system, the audio order receiving sub-system configured to be worn by the staff member;

decoding, with a second signal processor of the audio order receiving sub-system, the encoded audio communication signals received by the transceiver of the audio order receiving sub-system into wideband order information signals for a speaker of the audio order receiving sub-system;

receiving the wideband order information signals decoded with the second signal processor of the audio order receiving sub-system and generating sound represented in the received wideband order information signals such that the generated sound is audible to the staff member with the speaker of the audio order receiving sub-system;

receiving sound generated by the staff member and generating wideband order information signals that represent the received sound with a second microphone of the audio order receiving sub-system;

encoding, with the second signal processor of the audio order receiving sub-system, the wideband order information signals received from the second microphone of the audio order receiving sub-system into encoded audio communication signals for transmission by the transceiver of the audio order receiving sub-system;

transmitting, with the transceiver of the audio order receiving sub-system, the encoded audio communication signals encoded with the second signal processor of the audio order receiving sub-system to the transceiver of the base station;

receiving, with the transceiver of the base station, the encoded audio communication signals transmitted by the transceiver of the audio order receiving sub-system, decoding, with the first digital signal processor of the base station, the encoded audio communication signals received by the transceiver of the base station into wideband order information signals for a speaker of the audio order placement sub-system; and receiving the wideband order information signals decoded by the first digital signal processor of the base station and generating sound represented in the received wideband order information signals such that the generated sound is audible to the customer at or near the menu board with the speaker of the audio order placement sub-system;

wherein the wideband order information signals and the encoded audio communication signals represent sound having a frequency range in a wideband audio frequency range such that communication between the customer and the staff member is accomplished in wideband audio.

21. The method of claim 20, wherein the wideband order information signals and the encoded audio communication signals represent sound having a frequency range minimum and a frequency range maximum about 7000 Hz apart.

22. The system of claim 20, wherein the wideband order information signals and the encoded audio communication signals represent sound having a frequency range minimum and a frequency range maximum greater than about 4000 Hz apart.

23. The system of claim 20, wherein the wideband order information signals and the encoded audio communication signals represent sound having a minimum frequency between about 50 Hz and about 300 Hz and a maximum frequency of up to about 8000 Hz.

24. The method of claim 20, further comprising compressing wideband order information signals with the first digital signal processor and the second signal processor before transmission.

25. The method of claim 24, wherein a compression ratio of the compression by the first digital signal processor and the second signal processor is up to about 8:1.

26. The method of claim 20, wherein the customer is in a drive-through lane of the quick service restaurant.

27. The method of claim 20, further comprising providing acoustic echo cancellation with the first digital signal processor.

28. The method of claim 20, further comprising providing acoustic echo cancellation with the second signal processor.

29. The method of claim 20, further comprising providing noise reduction processing with the first digital signal processor.

30. The method of claim 20, further comprising providing noise reduction processing with the second signal processor.

31. The method of claim 20, further comprising associating the audio order receiving sub-system with an order entry device configured to receive entry and/or selection of an order by the staff member.

32. The method of claim 31, further comprising transmitting, with the order entry device, the order to a kitchen display system of the quick service restaurant.

33. The method of claim 31, further comprising processing a payment with the order entry device.

34. The method of claim 20, wherein the first microphone of the audio order placement sub-system is an array of microphones.

35. The method of claim 20, wherein the speaker of the audio order placement sub-system is an array of speakers.

36. The method of claim 20, wherein the transceiver of the base station and the transceiver of the audio order receiving sub-system are configured to transmit the encoded audio communication signals using multiple time slots.

* * * * *